US007287299B2

(12) United States Patent
Joynt

(10) Patent No.: US 7,287,299 B2
(45) Date of Patent: Oct. 30, 2007

(54) SIMPLIFIED REAR SQUEEGEE LINKAGE FOR SURFACE CLEANING EQUIPMENT

(75) Inventor: Daniel Lawrence Joynt, Wyoming, MN (US)

(73) Assignee: Tennant, Minneapolis, MN (US)

( * ) Notice: Subject to any disclaimer, the term of this patent is extended or adjusted under 35 U.S.C. 154(b) by 3 days.

(21) Appl. No.: 11/073,889

(22) Filed: Mar. 7, 2005

(65) Prior Publication Data

US 2005/0193519 A1 Sep. 8, 2005

Related U.S. Application Data

(60) Provisional application No. 60/550,886, filed on Mar. 5, 2004.

(51) Int. Cl.
*A47L 11/03* (2006.01)
*E01H 1/02* (2006.01)

(52) U.S. Cl. ..... 15/320; 15/50.1; 15/78; 15/401; 15/340.1

(58) Field of Classification Search ..... 15/320, 15/340.1, 340.2, 340.3, 340.4, 401
See application file for complete search history.

(56) References Cited

U.S. PATENT DOCUMENTS

| | | | | |
|---|---|---|---|---|
| 3,386,126 | A | 6/1968 | Hadekel | |
| 3,879,793 | A | 4/1975 | Schlegel | |
| 4,037,289 | A | 7/1977 | Dojan | |
| 4,805,258 | A * | 2/1989 | Sitarski et al. | 15/385 |
| 5,212,848 | A | 5/1993 | Geyer | |
| 5,454,138 | A * | 10/1995 | Mondigo et al. | 15/354 |
| 5,455,985 | A | 10/1995 | Hamline et al. | |
| 5,623,743 | A | 4/1997 | Borgoon et al. | |
| 5,943,730 | A | 8/1999 | Boomgaarden | |
| 6,088,873 | A * | 7/2000 | Pacchini et al. | 15/320 |
| 6,895,633 | B2 | 5/2005 | Tucker | |
| 2002/0170130 | A1 * | 11/2002 | Shinler | 15/49.1 |

* cited by examiner

*Primary Examiner*—David Redding
(74) *Attorney, Agent, or Firm*—Altera Law Group, LLC

(57) ABSTRACT

A rear squeegee linkage for surface cleaning equipment, which uses a pair of compliant bushings for improved shock absorption. The actuator is mounted with a pair of clevis pins and cotter pins, and may be replaced if needed without screwing or unscrewing any bolts or screws, or resetting any springs.

11 Claims, 5 Drawing Sheets

SIMPLIFIED REAR SQUEEGEE LINKAGE FOR SURFACE CLEANING EQUIPMENT

CROSS-REFERENCE TO RELATED APPLICATIONS

This application claims the benefit of U.S. Provisional Application No. 60/550,886, filed Mar. 5, 2004.

STATEMENT REGARDING FEDERALLY SPONSORED RESEARCH OR DEVELOPMENT

Not Applicable

BACKGROUND OF THE INVENTION

1. Field of the Invention

The present invention is directed to surface cleaning equipment, and more particularly to a squeegee linkage for surface cleaning equipment.

2. Description of the Related Art

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a squeegee assembly for wiping dry a floor which has been cleaned by application of a cleaning solution of water and a detergent in conjunction with scrubbing action of one or more moving brushes. Accordingly, the squeegee assembly of such prior art cleaning vehicles often mounts at or near the rear of the surface maintenance vehicle to direct the solution to a removal location where the solution (including suspended dirt, particles and contaminants) is removed. In this disclosure, the term "loaded cleaning solution" shall apply to such a cleaning solution after application thereof to a floor or other surface to be cleaned. The cleaning solution is typically supplied to the floor surface through or near rotary scrub brushes operating from a lower portion of the vehicle. The squeegee assembly may include a squeegee supporting member with a squeegee blade affixed to the supporting member to promote consistent contact with the surface to be cleaned and wiped. Alternately, the squeegee assembly may include more than one squeegee blade.

The squeegee blade and squeegee supporting member are attached to the frame of the vehicle by a squeegee linkage. Often the squeegee is a trailing type, used to collect any fluids which get past the cleaning/treating apparatus and provide a way to do a final clean up. This technology is applicable however to a leading or side retractable collector/surface treatment element (including a squeegee) and the claims should be interpreted as such. As the vehicle moves to clean a portion of a floor, the squeegee linkage should generally provide a constant downward force on the squeegee blade so that the blade remains uniformly engaged with the floor. In addition, the squeegee linkage should be able to retract the squeegee blade when the vehicle moves without cleaning, so that the blade does not damage the floor. Further, because the squeegee blade may protrude beyond the extent of the vehicle wheels, and the operator may inadvertently knock the blade into an immovable object, the squeegee linkage should be able to sustain a side impact without damage.

A prior art squeegee linkage, known as a "four bar" linkage, is used in a rider vehicle, model 7100, commercially available from the Tennant Company. In the four bar linkage, two parallel rods, horizontally spaced apart, are vertically pivotably attached to the frame of the vehicle at their first ends, and are vertically pivotably attached to the squeegee supporting member at their second ends, so that the squeegee supporting member may translate in the vertical direction. Additionally, two more parallel rods, located vertically adjacent to the first two rods, are similarly fastened to both the vehicle frame and the squeegee support member, so that when the squeegee supporting member translates, it maintains its angular orientation with respect to the vehicle frame. A tension spring provides a downward force on the squeegee supporting member, and an actuator is capable of raising the squeegee supporting member when required. The four bar linkage is relatively complicated, is relatively expensive, requires frequent adjustments, and provides relatively little shock absorption against horizontal impacts. Furthermore, if the actuator is damaged, a significant effort is required to access and replace the damaged part. A variation of the four bar linkage uses spherical rod bearings, which also provide for limited rotation in the horizontal plane. This allows for some side-to-side motion of the squeegee (such as under impact), but it also requires centering springs to consistently return the squeegee to its normal operating position, and spherical rod bearings add significantly to the cost of the system.

Another prior art squeegee linkage, known as a "pivoting plate" linkage, is used in a walk-behind vehicle, model 5400, also commercially available from the Tennant Company. The entire linkage is located on one side of a horizontal pin, and may be raised and lowered by an actuator by pivoting about the horizontal pin. Adjacent to the horizontal pin is a plate, which may pivot vertically about the horizontal pin, but has no horizontal adjustments. The plate is slidably fastened to a chuck at two locations—at a fixed slot, about which the chuck may pivot horizontally with respect to the plate, and at a pin, which freely slides horizontally along a generally horizontal slot located in the plate. The plate and the chuck move vertically as one unit, so that the entire linkage may be raised and lowered by an actuator. Because the pivoting plate linkage is designed for a walk-behind vehicle, in which the steering is done primarily from the rear wheels, the linkage is designed to swing freely from side-to-side, in order to ensure that the loaded solution is properly picked up during turns of the vehicle. This side-to-side motion is typically not required from a rider vehicle, in which the steering is generally done from the front wheels. Although simpler than the four bar linkage, the pivoting plate linkage is complicated, is fairly expensive, and provides only limited shock absorption. Likewise, if the actuator is damaged, a significant effort is required to access and replace the damaged part.

Accordingly, there is a need for a simplified (and therefore less expensive) squeegee linkage, with improved shock absorption, and with a quick release mechanism that improves access to a potentially damaged actuator.

BRIEF SUMMARY OF THE INVENTION

An embodiment is an apparatus for raising and lowering a trailing surface element such as a squeegee for a ground surface machine comprising a pivot point on said machine;

an actuator mounted at least on one end on said machine; an arm extending from said squeegee through said pivot point to said actuator; a resilient interface member between said machine and said arm at said pivot point so that shocks to said squeegee are absorbed at least in part by said interface member.

A further embodiment is a quick release interface member for joining an actuator to an arm, said arm used to raise or lower a structure on a ground cleaning machine, comprising: a rigid element having first and second ends; a first aperture proximate said first end; an elongated second aperture proximate said second end; a first connector passing through said first aperture; a second connector passing through said elongated second aperture, said first and second connectors connecting said actuator to said arm through said element so that said actuator can be removed from said machine without adjustment of the position of said arm.

There are many other elements of the invention as expressed in this specification and claims and this summary is only intended to be a quick guide. Reference should be had to the claims for full details of the invention.

DETAILED DESCRIPTION OF THE INVENTION

Figure 1:
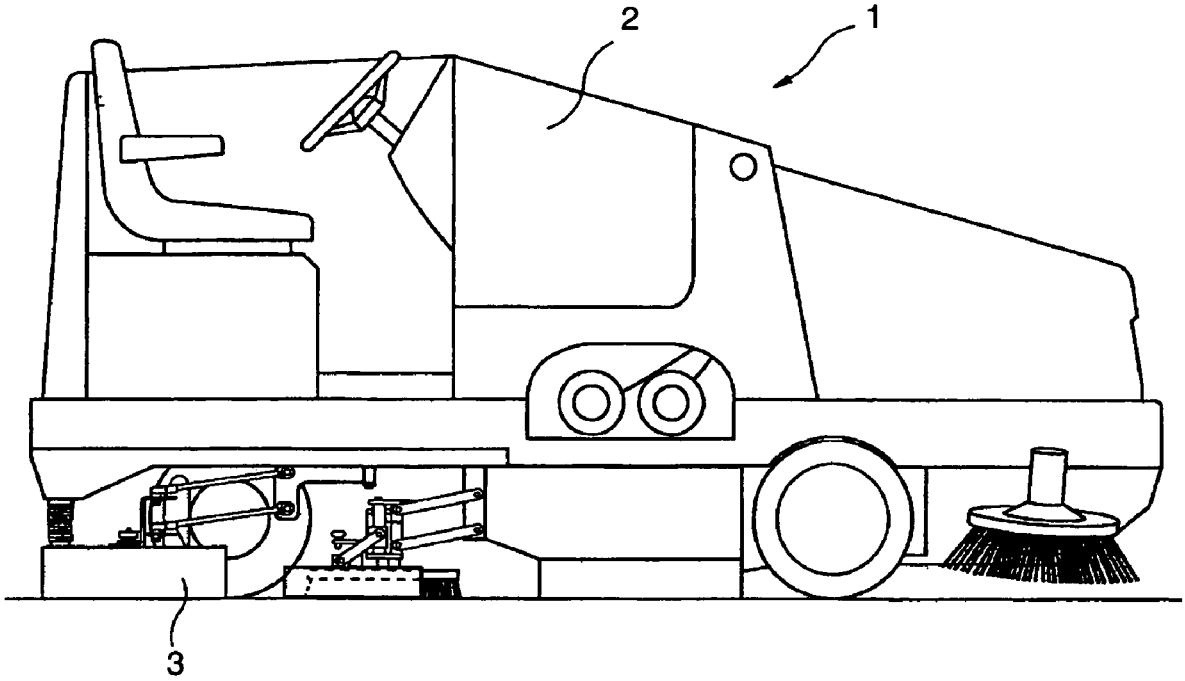
FIG. 1 is a plan drawing of a surface maintenance machine.

An embodiment of an industrial sweeper-scrubber is shown in FIG. 1. This surface maintenance machine may be used for sweeping and/or scrubbing floors in factories, warehouses, and other industrial or commercial establishments. As shown in FIG. 1, a riding-type surface maintenance vehicle 1 has a frame of the cleaning machine 2, and is supported on a plurality of front and rear wheels. Similarly, there are walk-behind surface maintenance vehicles, not shown in FIG. 1, which are generally smaller than the riding-type. Typically, such a surface maintenance vehicle 1 includes a variety of implements such as brushes and systems for dispensing cleaning solutions typically composed of detergent and water which suspend dirt. Herein, a cleaning solution containing suspended dirt and other particles shall be called a "loaded cleaning solution." Loaded cleaning solution and other liquid material are usually removed by a wiper blade assembly, referred to herein from time to time as a squeegee assembly. Such a squeegee assembly 3 is often mechanically coupled near the rear of a surface maintenance vehicle 1. The coupling between the squeegee assembly 3 and the frame 2 is shown schematically in FIG. 1 as two parallel rods, which is commonly used in the prior art four-bar squeegee linkage, but it will be understood that the illustration of FIG. 1 is designed merely to show that the squeegee assembly 3 may be raised and lowered while maintaining an orientation parallel to the floor.

Figure 2:
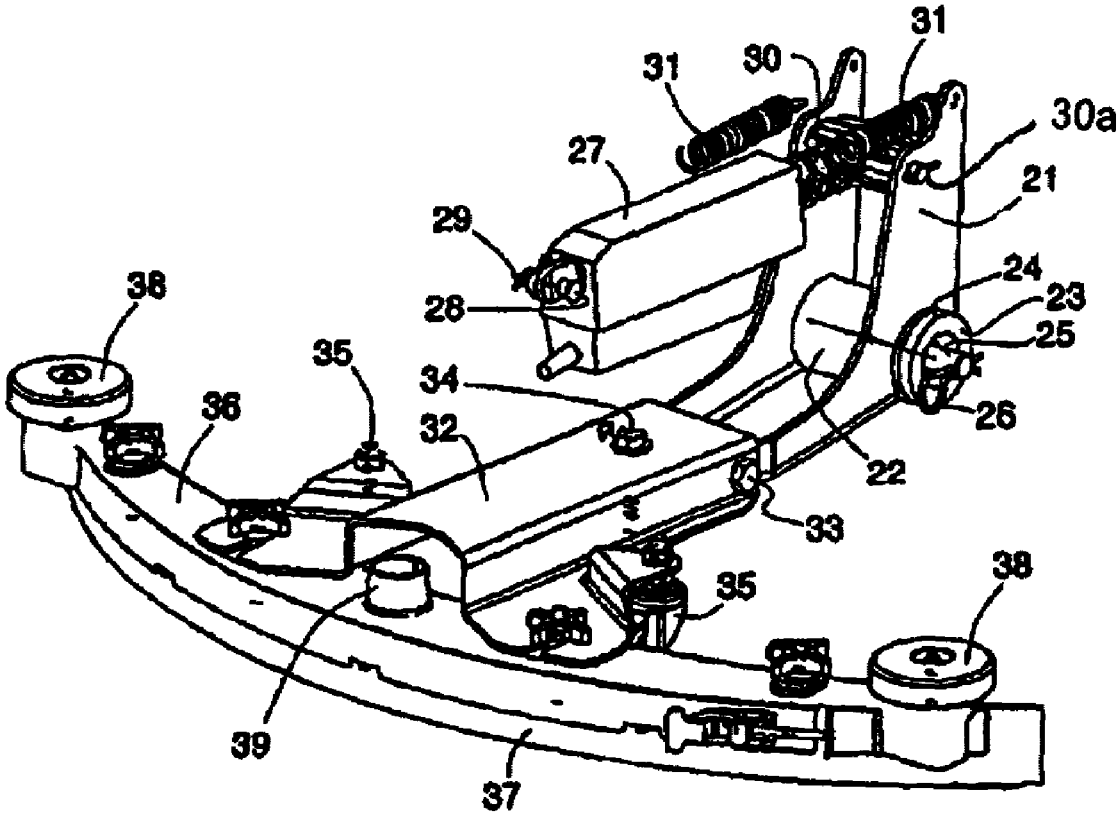
FIG. 2 is a perspective drawing of a squeegee linkage, viewed from above.
Figure 3:
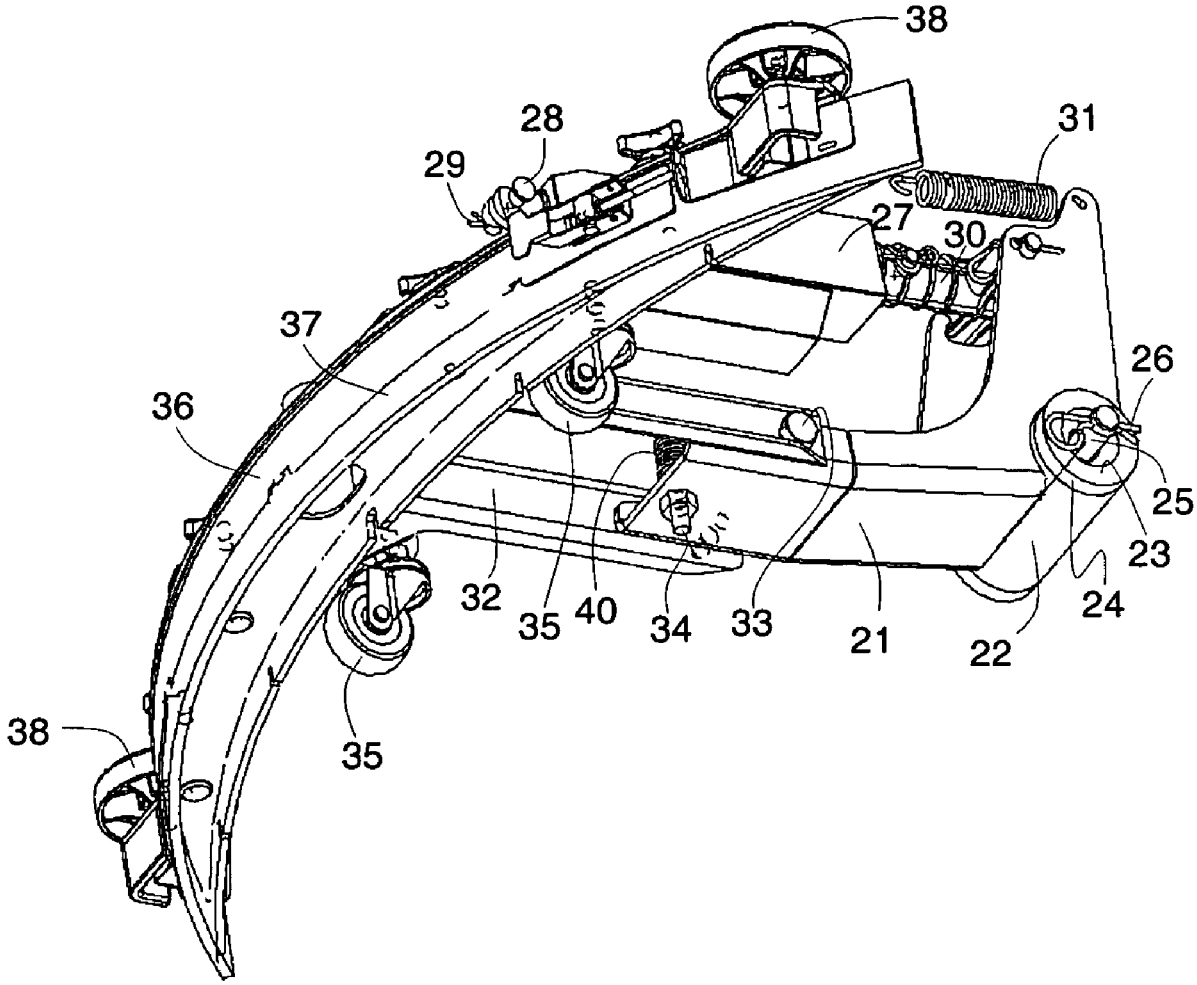
FIG. 3 is a perspective drawing of the squeegee linkage of FIG. 2, viewed from below.

FIGS. 2 and 3 shows an embodiment of a squeegee linkage, attached to a squeegee assembly. An upper channel arm 21 has a generally cylindrical hole through it, the outside of which is denoted by number 22. The upper channel arm 21 may be molded or cast from a variety of suitable materials such as reinforced polymers, cast aluminum or other cast metals, or sheet metals, such as steel. Alternately, the upper channel arm 21 may be assembled from smaller pieces.

A compliant bushing 23 is inserted into each side of the cylindrical hole in the upper channel arm 21. Each compliant bushing 23 has a shoulder 24 that has a diameter larger than the cylindrical hole in the upper channel arm 21, and protrudes beyond the edge of the upper channel arm 21 by the thickness of the shoulder 24. The compliant bushing 23 also has a hole coincident with its longitudinal axis, through which a pivot clevis pin 25 may be inserted. The geometry of the compliant bushing 23 is described in further detail below. The compliant bushing 23 may be made from urethane, rubber, or any other generally compliant material.

The upper channel arm 21 is pivotally attached to the frame of the vehicle (not shown) by the pivot clevis pin 25, which is secured in place by a cotter pin 26, adjacent to an edge of the pivot clevis pin 25. The frame has two colinear holes, spaced apart so that the upper channel arm 21 with two compliant bushings 23 may fit between the two colinear holes with a reasonable clearance on either side. The pivot clevis pin 25 fits through the two colinear holes in the frame, securing the upper channel arm 21 and compliant bushings 23 between them. Once secured the frame is spaced apart from the upper channel arm 21 by slightly more than the thickness of the shoulder 24, and the upper channel arm 21 may freely pivot vertically about the pivot clevis pin 25.

In order to raise the squeegee assembly, a force should be applied to the upper channel arm 21 at a distance away from the pivot clevis pin 25, in order to maximize a rotating torque for a given applied force. An actuator 27 provides the required force, and may preferably be a linear actuator, although a rotary actuator, lever, or anything that moves may also be used. For example, a suitable linear actuator 27 may be a 24 volt DC actuator, with a stroke of 50 mm, capable of supplying a force up to 500 N. Such a linear actuator is commercially available from the Linak Company, and is merely exemplary.

At a first end, the actuator 27 may be attached to the frame by an actuator attachment clevis pin 28 and actuator attachment cotter pin 29. At a second end opposite the first end, the actuator 27 may be attached to a spring housing 30 by an additional clevis pin and cotter pin. The actuator 27 changes the spacing between the first end and the second end in response to a controlling signal. The spring housing 30 connects the actuator 27 with the upper channel arm 21 via a clevis pin and cotter pin at each end. As the actuator 27 increases the separation between its ends, a torque is applied to the upper channel arm 21, and the squeegee assembly is raised off the ground.

During the cleaning operation, it is preferable to apply a downward force on the squeegee assembly, so that good contact is made everywhere between the squeegee blade and the floor. This downward force is preferably applied by one or more extension springs 31, shown as a pair in FIGS. 2 and 3. Each spring 31 connects the upper channel arm 21 to the frame (not shown). Alternatively, different types of springs may be used instead of extension springs, including but not limited to, compression springs, leaf springs and torsion springs.

Optionally, the spring or springs 31 may be replaced by a compression spring (not shown) enclosed by the spring housing 30 and clevis pin 30*a*. The spring housing 30 may be generally tubular in shape, open at a first end attached to the actuator, and preferably sealed at a second end opposite the first end. Between the first and second ends may be a slot that accommodates the clevis pin that attaches to the upper channel arm 21. The spring housing 30 may optionally contain a compression spring (not shown) between the sealed second end and the clevis pin located in the slot, in order to provide a biasing force on the upper channel arm 21 that forces the squeegee assembly into contact with the floor.

Note that because the actuator 27 is preferably attached to the frame of the vehicle by only a pair of clevis pins and cotter pins, and preferably does not support any springs or other fasteners in direct contact with the actuator. As a result, replacing the actuator 27 is a relatively simplistic process, involving the manipulation of a pair of clevis and cotter pins, and little else. This simplistic replacement process marks a significant improvement over prior art mounts for the actuator in a surface maintenance vehicle, which commonly involve replacing of screws, resetting of springs, or realignments of parts.

The upper channel arm 21, at an end opposite the actuator 27 and springs 31 may be adjustably fastened to lower channel arm 32. Although different methods of fastening may be used, such as welding or screws in various configurations, an exemplary fastening method is shown in FIGS. 2 and 3. A pair of horizontally-oriented side hex screws 33 and nuts (not shown) fasten the upper channel arm 21 to the lower channel arm 32, so that the side-to-side movement between the parts is restricted, but a small vertical adjustment between the parts may be made. A vertically oriented top hex screw 34 fastens the upper channel arm 21 to the lower channel arm 32, preferably with a compression spring 40 between them so that a vertical adjustment may be made between the parts by adjusting the top hex screw 34. Typically, this is adjustment is made at the factory. By allowing this adjustment, a number of manufacturing and assembly tolerances may therefore be relaxed, resulting in a less expensive product. Alternatively, the upper channel arm 21 and the lower channel arm 32 may be manufactured as a single unit. Alternatively, the hex screw 33 may be a single part versus two individual screws as described above, extending all the way through both squeegee arm channels, and may be secured by a nylon-lock nut on the end.

A pair of swivel casters may be mounted beneath the lower channel arm 32, as an inexpensive method of maintaining a minimum height of the lower channel arm 32 above the floor.

Removably attached to the end of the lower channel arm 32, opposite the upper channel arm 21, is a squeegee holder 36. The squeegee holder 36 may support a replaceable squeegee blade 37, and may have a pair of guide wheels 38 that assist in guiding the squeegee around various objects as the vehicle moves. During operation, a vacuum hose (not shown) connects to the squeegee at a nozzle 39.

Figure 4:
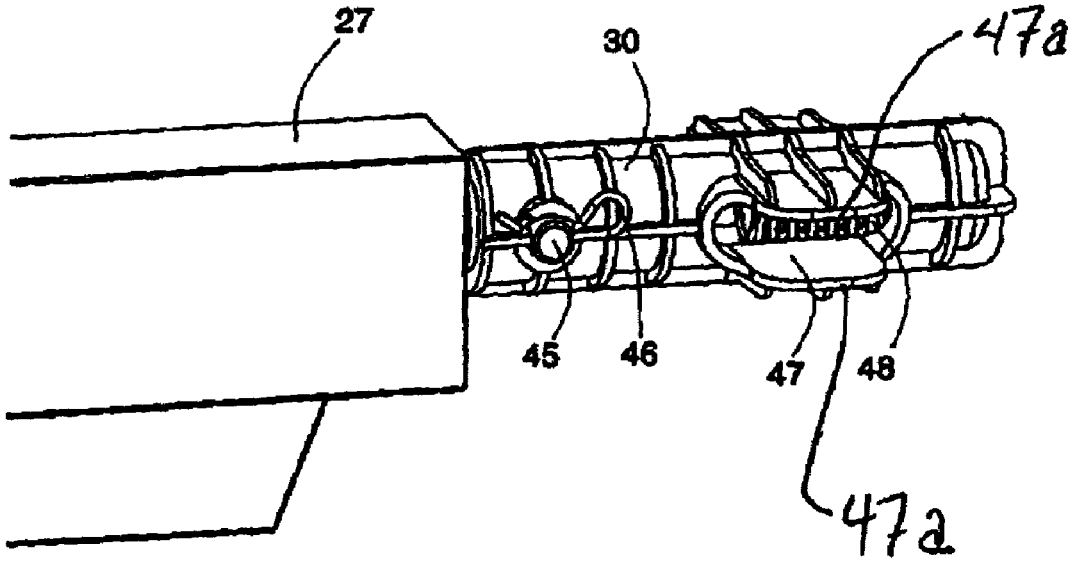
FIG. 4 is a perspective drawing of a spring housing.

FIG. 4 shows a more detailed view of the spring housing 30, preferably attached to the actuator 27 by a clevis pin 45 and cotter pin 46. The spring housing 30 may have a slot 47, through which an additional clevis pin may extend and attach to the upper channel arm 21. As the actuator 27 extends, the spring housing is forced to the right in FIG. 4, and once the clevis pin reaches the leftmost edge of the slot 47, the force exerted by the slot on the clevis pin, and in turn on the upper channel arm 21, raises the squeegee assembly. For replacement of a damaged actuator, the cotter pins 29 and 46 are removed, then the clevis pins 28 or 45 are removed, thus freeing the actuator. Installation of a new actuator involves inserting the clevis pins 28 and 45, then the cotter pins 29 and 46. It is noteworthy that the actuator replacement process is as simple as manipulating these pins, and it is worth pointing out that there are no screws to fasten or unfasten, no parts to realign, and no springs to reset. Note the guide flanges protruding outwardly from the slot, which may strengthen the spring housing 30 in the vicinity of the slot 48, and may reduce undesirable rotation of the actuator, the clevis pin, or the spring housing with respect to each other.

An optional alternative to the springs 31 that provide a downward force on the squeegee assembly is a compression spring 48, located between the sealed end of the spring housing 30 and the clevis pin (not shown) that extends through the slot 47 and flanges 47*a*. Note that because both the actuator 27 and the spring housing 30 are non-slidingly attached to the frame, the compression spring 48 applies a functionally equivalent force against the upper channel arm 21 (as compared with the springs 31), and does so in a compact environment with fewer parts. Furthermore, the compression spring 48 may also act as a damper for the action of the actuator, and may take up any slack in the slot from the movement of the clevis pin.

Figure 5:
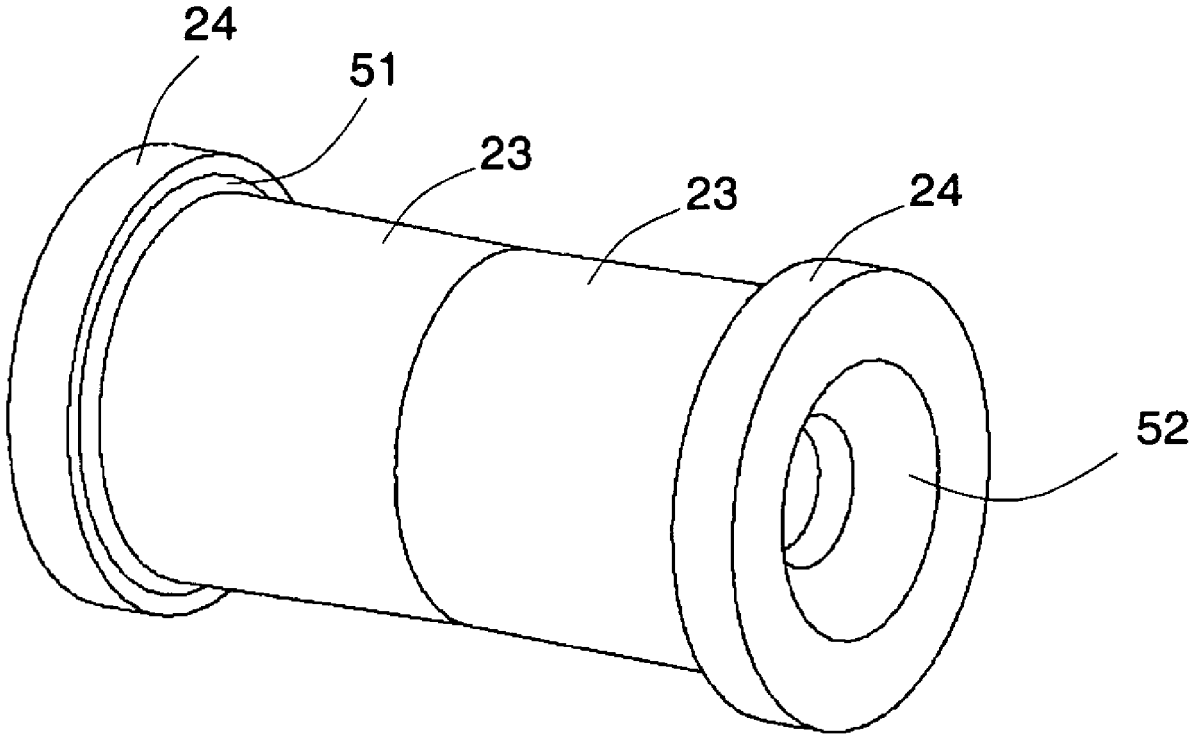
FIG. 5 is a perspective drawing of a pair of compliant bushings.

FIG. 5 shows a pair of compliant bushings 23 drawn back-to-back, oriented as inserted into each side of the cylindrical hole in the upper channel arm 21. The bushing is preferably a resilient liner between the hole and pin, sufficiently rigid to prevent undue torsional movement of the squeegee, but sufficiently resilient to absorb shocks to the squeegee and reduce or avoid damage to the actuator. Although they are drawn in contact in FIG. 5, the compliant bushings 23 may be shorter in extent, so that when inserted into each end of the cylindrical hole in the upper channel arm 21, there may be a gap between them.

The compliant bushings 23 are generally inserted until the shoulder 24 contacts the upper channel arm 21 in the circumference around the cylindrical hole. As a result, a rounded corner 51 may be less desirable, in that the point of contact becomes ill-defined, and may lead to a tightened mechanical tolerance budget elsewhere in the system, or may even lead to an accelerated wearing out of the compliant bushings 23 during use. Preferably, the region denoted by 51 may be hollowed out by a small radius in the vicinity of the seam between the shoulder 24 and the cylindrical portion that fits inside the cylindrical hole, leading to a more predictable region of contact when the compliant bushings 23 are inserted. Additionally, the small radius in region 51 may reduce stress concentrations, such as from a sharp corner, and may also facilitate the molding process. For largely the same reason, the hole through which the pivot clevis pin 25 is inserted may be countersunk, as shown by countersunk region 52 in FIG. 5.

Additionally, because the bushings 23 are intended to be compliant, the removal of material in the regions 51 and 52 may increase the compliance in the horizontal plane as the squeegee arm rotates relative to the pivot pin 25, while maintaining higher stiffness in the vertical plane to maintain their function as pivot bushings.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. An apparatus for raising and lowering a trailing surface treatment element for a ground surface treating machine comprising:

a pivot point on said machine including a cylindrical aperture;

an actuator mounted at least on one end on said machine;

an arm extending from said element through said pivot point to said actuator;

a resilient interface member between said machine and said arm at said pivot point so that shocks to said element are absorbed at least in part by said interface member, wherein said resilient interface member includes a pair of separate cylindrical bushings sized be received, at least in part, within said aperture, said bushings including a shoulder portion configured to extend from said bushing but remain outside said aperture, said shoulder portion being of greater diameter than said bushings, a pin assembly extending through said bushings and engaging at least a portion of both shoulder portions, so that said bushings are maintained within said aperture and wherein the shoulder includes countersunk recess.

2. The apparatus of claim 1 wherein said bushing is of sufficient rigidity to limit torsional movement of the arm.

3. The apparatus of claim 1, wherein the bushing includes an aperture and wherein a removable pin extends therethrough and through the pivot point.

4. The apparatus of claim 3, wherein the machine includes a frame having first and second members space apart a predetermined distance, each member containing an aperture sized to receive said pin.

5. An apparatus for raising and lowering a trailing surface treatment element for a ground surface treating machine comprising:

a pivot point on said machine;

an actuator mounted at least on one end on said machine;

an arm extending from said element through said pivot point to said actuator;

a resilient interface member between said machine and said arm at said pivot point so that shocks to said element are absorbed at least in part by said interface member; wherein said interface member is a resilient bushing of sufficient rigidity to limit torsional movement of the arm, wherein the bushing includes an aperture and wherein a removable pin extends therethrough and through the pivot point; wherein the arm has a cylindrical space and wherein said bushing is sized to be received therein and, wherein said bushing has end faces and wherein at least one of said faces is recessed so that said pin is countersunk into said face.

6. The apparatus of claim 5, wherein the bushing includes a first and second shoulder on each of its ends and wherein said shoulder has a predetermined thickness, so that the maximal distance between said shoulders is generally equal to said predetermined distance between said members.

7. The apparatus of claim 6, wherein said bushing includes first and second halves each having a shoulder.

8. A interface member for joining an actuator to an arm, said arm used to raise or lower a structure on a ground treatment machine, comprising:

an element having first and second ends;

a first aperture proximate said first end;

an second aperture proximate said second end;

a first connector passing through said first aperture;

a second connector passing through said second aperture, said first and second connectors connecting said actuator to said arm through said element, and including a pair of opposing spaced apart guide flanges adjacent said aperture, to limit rotation between said second connector and said element.

9. The member of claim 8, wherein the element is rigid and includes a bias member for urging one of said second connector toward one end of said second aperture.

10. The member of claim 8 wherein said second aperture is an elongated slot and wherein said flanges include a pair of upper and lower opposing members extending from said element, together creating a boundary to limit the torsional movement of said second connector.

11. A quick release interface member for joining an actuator to an arm, said arm used to raise or lower a structure on a ground treatment machine, comprising:

an element having first and second ends;

a first aperture proximate said first end;

an elongated second aperture proximate said second end;

a first connector passing through said first aperture;

a second connector passing through said elongated second aperture, said first and second connectors connecting said actuator to said arm through said element, so that said actuator can be released from said machine without adjustment of the position of said arm; and wherein said elongated second aperture includes a pair of guide flanges on both sides of said aperture, to limit rotation between said second connector and said element.

* * * * *